US008322406B2

(12) United States Patent
Du et al.

(10) Patent No.: US 8,322,406 B2
(45) Date of Patent: Dec. 4, 2012

(54) THERMALLY CONDUCTIVE POROUS ELEMENT-BASED RECUPERATORS

(75) Inventors: Jian Hua Du, Orlando, FL (US); Louis C Chow, Orlando, FL (US); Yeong-Ren Lin, Orlando, FL (US); Wei Wu, Orlando, FL (US); Jayanta Kapat, Oviedo, FL (US); William U. Notardonato, Merritt Island, FL (US)

(73) Assignee: University of Central Florida Research Foundation, Inc., Orlando, FL (US)

( * ) Notice: Subject to any disclaimer, the term of this patent is extended or adjusted under 35 U.S.C. 154(b) by 619 days.

(21) Appl. No.: 12/502,415

(22) Filed: Jul. 14, 2009

(65) Prior Publication Data

US 2010/0006273 A1 Jan. 14, 2010

Related U.S. Application Data

(60) Provisional application No. 61/080,413, filed on Jul. 14, 2008.

(51) Int. Cl.
*F25D 3/12* (2006.01)

(52) U.S. Cl. ..... 165/166; 166/907

(58) Field of Classification Search ..... 165/165, 165/166, 907

See application file for complete search history.

(56) References Cited

U.S. PATENT DOCUMENTS

| | | | | |
|---|---|---|---|---|
| 4,222,434 | A * | 9/1980 | Clyde | 165/10 |
| 6,033,506 | A | 3/2000 | Klett | |
| 6,261,485 | B1 | 7/2001 | Klett | |
| 2002/0108743 | A1 * | 8/2002 | Wirtz | 165/185 |

FOREIGN PATENT DOCUMENTS

| | | | |
|---|---|---|---|
| JP | 58072889 | * | 4/1983 |
| JP | 58072889 A | * | 4/1983 |

OTHER PUBLICATIONS

Wu, W., et al. "Design and Experiment of Compact and Effective Carbon Foam Recuperative Heat Exchangers." Journal of Thermophysics and Heat Transfer vol. 23, No. 2, Apr.-Jun. 2009.

* cited by examiner

*Primary Examiner* — Frantz Jules
*Assistant Examiner* — Henry Crenshaw
(74) *Attorney, Agent, or Firm* — Jetter & Associates, P.A.

(57) ABSTRACT

A heat exchanger includes at least one hot fluid flow channel comprising a first plurality of open cell porous elements having first gaps therebetween for flowing a hot fluid in a flow direction and at least one cold fluid flow channel comprising a second plurality of open cell porous elements having second gaps therebetween for flowing a cold fluid in a countercurrent flow direction relative to the flow direction. The thermal conductivity of the porous elements is at least 10 W/m·K. A separation member is interposed between the hot and cold flow channels for isolating flow paths associated these flow channels. The first and second plurality of porous elements at least partially overlap one another to form a plurality of heat transfer pairs which transfer heat from respective ones of the first porous elements to respective ones of the second porous elements through the separation member.

16 Claims, 4 Drawing Sheets

THERMALLY CONDUCTIVE POROUS ELEMENT-BASED RECUPERATORS

CROSS REFERENCE TO RELATED APPLICATIONS

This application claims the benefit of Provisional Application Ser. No. 61/080,413 entitled "COMPACT, LIGHTWEIGHT AND EFFICIENT THERMALLY CONDUCTIVE FOAM-BASED HEAT EXCHANGERS AND SYSTEMS THEREFROM", filed Jul. 14, 2008, which is herein incorporated by reference in its entirety.

U.S. GOVERNMENT RIGHTS

The U.S. Government has rights to embodiments of the invention based on National Aeronautics and Space Administration (NASA) Grant #NNX07AL16G.

FIELD

Embodiments of the invention relate to heat exchangers and related systems, and more particularly heat exchangers based on thermally conductive porous materials.

BACKGROUND

Recuperative type heat exchangers are heat exchangers in which fluids exchange heat on either side of a thermally conductive dividing wall. Conventional recuperative type heat exchangers are often based on aluminum or copper and are generally large in size and heavy. Such heat exchangers lack modularity, scalabability, and also generally fail to provide high effectiveness (e.g., typically an effectiveness ($\epsilon$)<90%).

For certain applications, heat exchangers are needed that provide high effectiveness, scalability, as well as being compact and lightweight. For example, compact crycoolers are needed for space exploration.

SUMMARY

This Summary is provided to comply with 37 C.F.R. §1.73. It is submitted with the understanding that it will not be used to interpret or limit the scope or meaning of the claims.

Recuperative heat exchangers described herein generally comprise at least one hot flow channel and at least one cold flow channel. In operation, the hot and cold fluids flow in opposite directions in the heat exchanger. The flow channels each comprise a plurality of open cell porous elements of a material that provides a thermal conductivity of at least 10 W/m·K. Thermal conductivity values reported herein are understood to be room temperature values. There are gaps between the porous elements. The gaps between the porous elements have been found by the Inventors to significantly reduce the axial thermal transport in the gas phase. The axial direction as used herein refers to the fluid flow direction.

The porous elements are arranged as a plurality of individual heat transfer pairs, each comprising a porous element on one side of a separation member which separates the hot and cold flow channels paired with another porous element on the other side of a separation member. The separation member is generally thin and comprises a relatively low thermal conductivity material, such as a material that provides a 25° C. thermal conductivity of <30 W/m·K. The thin separation member reduces the thermal resistance between the hot and cold flow channels and increases the thermal resistance for axial thermal conduction. The thermal conductivity of the porous elements further enhances heat transfer between the hot and cold fluids which allows the size of the heat exchanger to be reduced compared to conventional recuperative heat exchanger designs.

The hot and cold flow channels can be piled alternately in a modular manner. Embodiments of the invention, unlike conventional heat exchangers, have advantages in size and weight and can be scaled up for larger systems. Such heat exchangers can provide an effectiveness ($\epsilon$) of generally >95%, such as more than 98%.

DETAILED DESCRIPTION

Figure 1:
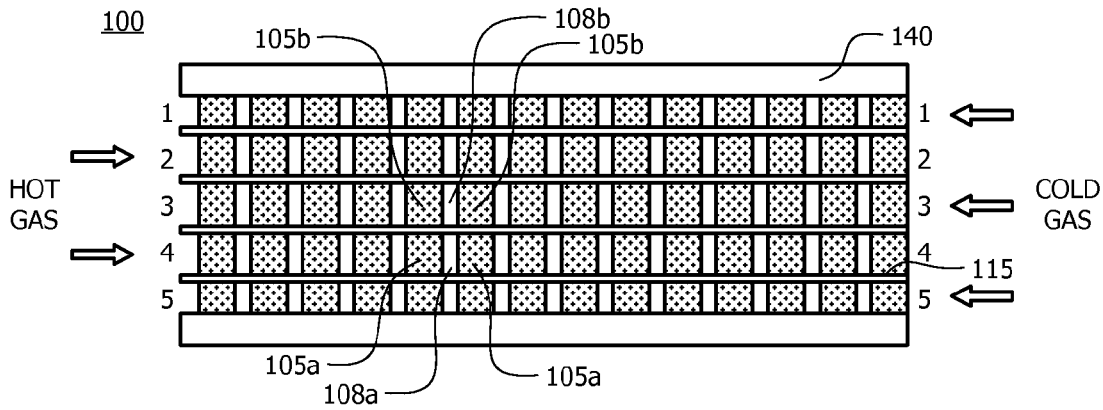
FIG. 1 is a schematic of an exemplary recuperative heat exchanger according to an embodiment of the invention.

Embodiments of the invention are described with reference to the attached figures, wherein like reference numerals are used throughout the figures to designate similar or equivalent elements. The figures are not drawn to scale and they are provided merely to illustrate the instant invention. Several aspects of the invention are described below with reference to example applications for illustration. It should be understood that numerous specific details, relationships, and methods are set forth to provide a full understanding for embodiments of the invention. One having ordinary skill in the relevant art, however, will readily recognize that embodiments of the invention can be practiced without one or more of the specific details or with other methods. In other instances, well-known structures or operations are not shown in detail to avoid obscuring the invention. Embodiments of the invention are not limited by the illustrated ordering of acts or events, as some acts may occur in different orders and/or concurrently with other acts or events. Furthermore, not all illustrated acts or events are required to implement a methodology in accordance with embodiments of the invention.

A first embodiment of the invention describes a recuperative heat exchanger, comprising at least one hot fluid flow channel for flowing a hot fluid in a flow direction and at least one cold fluid flow channel for flowing a cold fluid in a countercurrent flow direction. The flow channels each comprise a plurality of open cell porous elements having gaps therebetween. As defined herein, an "open cell porous element" has at least 50% porosity and has pores whose cavities are connected to one another (i.e. open-cell porosity) to permit fluidic communication throughout. Although the open cell porous elements are generally described herein as being foams, such porous elements can also be embodied as other open cell porous materials, such as certain sponges, fabrics, and even some non-woven materials provided the materials are open-celled, have sufficient thermal conductivity and thus permit fluidic communication throughout.

FIG. 1 shows a schematic cross section of an exemplary gas counter flow type recuperative heat exchanger 100, according to an embodiment of the invention. Heat exchanger 100 is shown including a plurality of flow channels, shown in FIG. 1 as 1, 2, 3, 4 and 5. The hot fluid flow channels are identified as channels 2 and 4 while the cold fluid flow channels are identified as channels 1, 3, and 5, and are thus piled alternatively (cold/hot/cold, etc.). A thermally insulating framing material 140, such as fiberglass or polytetrafluoroethylene (PTFE), is shown in FIG. 1 and is provided on the top and bottom of the heat exchanger 100. The number of flow channels can be increased or decreased according to the volume flow rate of the hot and cold gas to be processed.

The basic cooling unit in heat exchanger 100 is referred to herein as a heat transfer pair (see heat transfer pair 200 shown in FIG. 2 described below) that each comprises a porous element 105(*a*) in the hot flow channel overlapping at least in part and thermally coupled to a porous element 105(*b*) in an adjacent cold fluid flow channel by a thin sheet of a solid material referred herein as a separation member 115.

The separation members 115 are interposed between the first and second flow channels to isolate the flow paths associated with the first and second flow channel. The material and thickness of the separation members 115 are selected to minimize axial thermal conduction along the separation member 115. The selection generally comprises selecting a thin member with a low to moderate bulk thermal conductivity material (e.g. stainless steel, glass), that is thin enough to minimize axial conduction (due to small cross section area for heat to flow axially). Separation members 115 generally have a thickness <1 mm and comprise a material that provides a thermal conductivity of <30 W/m·K. For example, a commercially available 100 micron-thick stainless steel plate (k=15 W/m·K) can be used for the separation member 115. Since the thickness of the separation member is small, the sheet does not introduce significant thermal resistance for heat transfer in the transverse direction to cross the separation member 115 to transfer heat from the hot side to the cold side. Although not known to be currently commercially available, when available, heat exchanges according to embodiments of the invention can benefit from anisotropic separation members that provide a higher thermal conductivity in the transverse direction as compared to the axial direction.

Porous elements 105(*a*) and 105(*b*) are collectively referred to porous elements 105. Porous elements 105 are generally sized 1-50 mm in length, 10-500 mm in width and 5-50 mm in height. In one embodiment, the length of the porous elements (i.e. in the flow direction) is between 5 and 20 mm. Regarding shapes for the porous elements 105, although generally depicted herein as having a rectangular cross section, porous elements 105 can have a variety of other shapes, such as a square or I-beam cross section.

The thermal conductivity of the porous elements 105 is at least 10 W/m·K. In one embodiment, the porous elements comprise graphitic carbon foam that provides a bulk thermal conductivity at 25° C. of >100 W/m·K in at least one direction.

Thermally conductive porous elements, such as carbon (e.g. graphitic) foam based, provide the fin effect that increases heat transfer efficiency from the hot side to the cold side. As noted above, heat exchangers according to embodiments of the invention can provide high effectiveness (e.g., $\epsilon$>95%) and can be easily scalable, compact and light.

A specific embodiment of the invention uses high thermal conductivity graphite foam developed by Oak Ridge National Laboratory and licensed to Poco Graphite, Inc. which manufactures two graphite foam products in accordance with this technology, e.g., POCO FOAM™ and POCO HTC™. U.S. Pat. No. 6,033,506 to Klett entitled "Process for Making Carbon Foam" discloses methods of making highly graphitic carbon foam that can be used in accordance with embodiments of the invention, and is hereby incorporated by reference in its entirety. See also J. Klett, Proceedings of the 1998 43rd International SAMPE Symposium and Exhibition, Part 1 (of 2), Anaheim, Calif., U.S.A., May 31-Jun. 4, 1998; J. Klett, Journal of Composites in Manufacturing 15, 1-7 (1999); U.S. Pat. No. 6,261,485 to Klett entitled "Pitch-Based Carbon Foam and Composites".

As shown in FIG. 1, the hot and cold gases are arranged to enter the respective flow channels to realize counter flow as shown in FIG. 1. This can be implemented by attaching flow manifolds having openings in proper locations at both ends of the recuperative heat exchanger (not shown). Gaps 108(*a*) are provided between neighboring porous elements 105(*a*), while gaps 108(*b*) are provided between neighboring porous elements 105(*b*). Gaps 108(*a*) and 108(*b*) are collectively referred to herein as gaps 108. The gaps 108 reduce the axial thermal conduction which has been found by the Inventors to significantly raise the effectiveness ($\epsilon$) of heat exchanger 100. Gaps 108 generally range in size from 1-10 mm.

The gaps 108 are generally spaces (i.e. empty gaps) between the foam blocks 105 and are thus generally "empty", that in operation they are generally only filled with the hot and cold fluids, respectively. In typical operation, the hot and the cold fluids are thermally insulating gases that provide a thermal conductivity of <0.2 W/m·K. The fluids (gases) used can include, for example, nitrogen, oxygen, air, hydrogen, helium and neon. These gases have a very low thermal conductivity, such as <0.1 W/m·K. Alternatively, the gaps 108 can be at least partially filled with an open cell material that provides a bulk thermal conductivity at 25° C. of <1 W/m·K, such as for adding structural support for the heat exchanger.

The series of porous elements 105 in each flow channel shown in FIG. 1 are used instead of one continuous piece that is commonly used in conventional heat exchangers. The gaps 108 act as thermal insulators. This arrangement significantly raises the thermal resistance of the thermal path of the foam in the axial direction. The low thermal conductivity of gases has been found to generally dominate the thermal resistance in the flow region. This arrangement is beneficial to heat transfer in the transverse direction.

The stacked parallel plate arrangement shown in FIG. 1 allows symmetrical counter flow passages that balance the flow across each heat transfer interface provided by the separation member 115. The foam blocks 105 on both sides of the separation plates 115 are shown aligned with one another to improve heat transfer efficiency from the hot to cold gas streams. The design shown is modular and can be scaled up for large capacity with more alternating hot and cold stacks.

Although the effectiveness ($\epsilon$) of each heat transfer pair 105(*a*)/115/105(*b*) may be relatively low, such as about 0.5 or slightly higher, the use of a series of heat transfer pairs (e.g., 20 or more) generally results in the overall effectiveness ($\epsilon$) of heat exchangers according to embodiments of the invention to be high. Accordingly, each heat transfer pair 105(*a*)/115/105(*b*) is only generally needed to provide a temperature change of several degrees for the hot and cold gases.

In order to reduce the size of the heat exchanger 100, the heat transfer in the transverse direction (transverse to the gas streams, i.e. from hot to cold) is increased. Thermally conductive carbon foam (e.g., highly graphitic foam) can be used to increase heat transfer coefficient on both the hot gas and cold gas sides. Thermally conductive carbon foam has very high specific thermal conductivity (thermal conductivity/density) as compared to conventional heat exchanger materials, including common metals for heat transfer such as copper and aluminum. The open cell structures of the thermally conductive carbon foam gives it a high heat transfer coefficient, typically more than 5 times that of metal foams and conventional fin structures. The combination of the heat transfer coefficients flowing inside the open cell foam, the high thermal conductivity of the foam (e.g., highly graphitic carbon foam ligaments (providing high fin thermal efficiency)) and high heat transfer surface area, all lead to significantly enhanced overall heat exchanger performance for heat exchangers according to embodiments of the invention. The low density of the certain open cell porous materials such as thermally conductive carbon foam also makes the heat exchanger 100 generally lightweight.

Other thermally conductive carbon foams having the thermal conductivity specified above can also be used with embodiments of the invention. For example, certain compressed metal foams (e.g. aluminum foam) can provide a thermal conductivity of 25 W/m·K, or more. Other high thermal conductivity foams or high porosity matrices may also generally be used.

In operation of heat exchanger 100, heat is transferred from the hot fluid to the cold fluid in the transverse direction (from hot to cold flow channels/perpendicular to the axial/fluid flow direction). In the transverse heat flow direction, heat flows from hot stream through the foam blocks on the hot side 105(*a*), crossing the thin separation member 115, then to the foam blocks on the cold side (105(*b*), and then finally to the cold fluid stream.

A thermally conductive adhesive 150 (e.g., S-bond or silver loaded epoxy, see FIG. 2) can be used to bond the foam blocks 105(*a*) and (b) to the separation members 115. Such bonding layers help reduce the total thermal resistance between the hot and cold sides of the heat exchanger 100.

Figure 2:
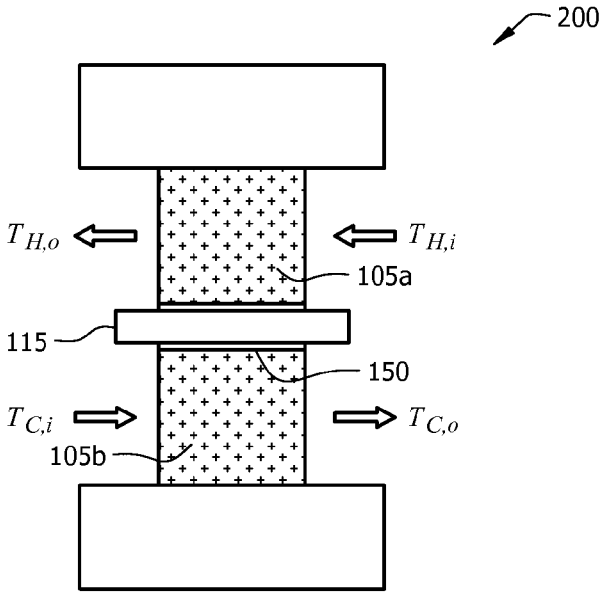
FIG. 2 depicts heat transfer between a heat transfer pair comprising pair of open cell porous elements, according to an embodiment of the invention.

A performance model was used to assess the extent a heat transfer pair comprising a pair of porous elements embodied as carbon foam blocks separated by a separation member could raise the temperature of the cold stream (or equivalently reduce the temperature of the hot stream). FIG. 2 shows a foam block heat transfer pair 200 comprising a pair of foam blocks 105(*a*) and 105(*b*) separated by and bonded to a separation member 115. A thermally conductive adhesive bonding layer 150 is shown bonding the foam blocks 105(*a*) and (b) to the separation members 115. The inlet temperatures of the hot and cold streams are shown as $T_{H,i}$, and $T_{C,i}$, respectively while the outlet temperatures are $T_{H,o}$, and $T_{C,o}$. Heat transfer from hot to cold is enhanced by thermal conduction in the transverse direction through the foam blocks 105.

Heat transfer through the foam blocks 105 was modeled as extended surfaces (as the fin effect). The carbon foam was modeled as straight fins with a 300-micron gap between two fins (equal to the mean pore size of the carbon foam). This did not actually simulate the carbon foam as a porous medium, but instead treated the foam like a fin structure, which helped improve the heat transfer coefficient. The fin was assumed to have a thickness of 100 microns, which is consistent with the average thickness of the ligament and the porosity of the POCO FOAM™ The thermal conductivity of the fins along the fin direction is 550 W/m·K, while in the axial (flow) and transverse directions (across the fin thickness of 100 microns), the thermal conductivity is 180 W/m·K. These values are consistent with the thermal conductivity of the carbon ligament and the anisotropic bulk thermal conductivities of POCO FOAM™ where in one direction, the effective thermal conductivity is 135 W/m·K and 45 W/m·K in the other two directions.

Modeling software (COMSOL MULTIPHYSICS™ Comsol Inc., Palo Alto, Calif.) was used to couple this problem using the Incompressible Navier-Stokes package and the Conduction and Convection package. The inlet temperatures of the hot and cold streams are given as 300K and 289K, respectively. Simulation results demonstrated that the hot gas can be cooled from 300K to 293.5K by the heat transfer pair 200 while the cold gas can be heated from 289K to 295.5K. The effectiveness ($\epsilon$) for the heat transfer pair 200 simulated was 59.1%. The mean velocity flowing through the channels was assumed to be V=0.44 m/s.

As described above, the effectiveness of heat exchangers according to embodiments of the invention is increased by increasing the number of heat transfer pairs/number of porous elements in series in the axial direction. Below, an approach is described to achieve a 98% effectiveness. One current requirement for an application for a heat exchanger according to an embodiment of the invention is for the temperature of the hot stream to decrease from 298 to 98K (a 200K difference), while the temperature of the cold stream is needed to increase from 94 to 294K (also a 200K difference). This can be accomplished with at least about 50 heat transfer pairs 200, each pair responsible for about a 4K temperature change. The effectiveness of each pair 200 is generally much lower than 90% due to axial thermal conduction in the porous elements from the hot end to the cold end for the pair 200. If the thermal conductivity of the porous elements in the axial direction is high, the effectiveness for the pair 200 could be as low as 50%. The overall high effectiveness of the heat exchanger is achieved through a series of porous elements. Thus, each heat transfer pair is just responsible for only a temperature change of several degrees.

Figure 3:
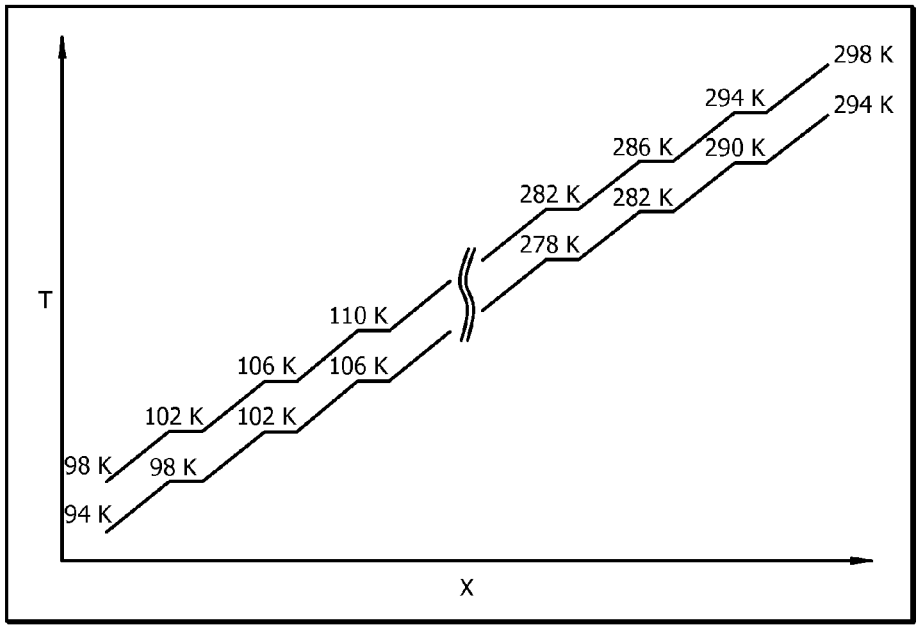
FIG. 3 shows data for axial temperature distributions within a heat exchanger according to an embodiment of the invention assuming an effectiveness ($\epsilon$) of 0.5 for each heat transfer pair.

FIG. 3 shows a plot of temperature (in K) vs. axial position (x) demonstrating the stepwise change of the temperature an exemplary heat exchanger, where the constant temperature regions correspond to gap regions between the neighboring porous elements associated with the heat transfer pairs 200. As described above, the number of heat transfer pairs 200 in the design of heat exchanger depends on the performance of each pair and the temperature difference required. The relation between the overall effectiveness, and the effectiveness for each pair 200, e, can be expressed as follows:

$$\varepsilon = \frac{Ne}{1 + (N-1)e} \tag{1}$$

where N is the number of heat transfer pairs 200.

If the effectiveness for each pair 200 is 50%, the overall effectiveness can reach as high as 98% through at least about 50 pairs 200 in series. From this analysis, using discrete 1-cm graphitic foam blocks can result in an overall effectiveness of 98% for heat exchangers according to embodiments of the invention.

Figure 4:
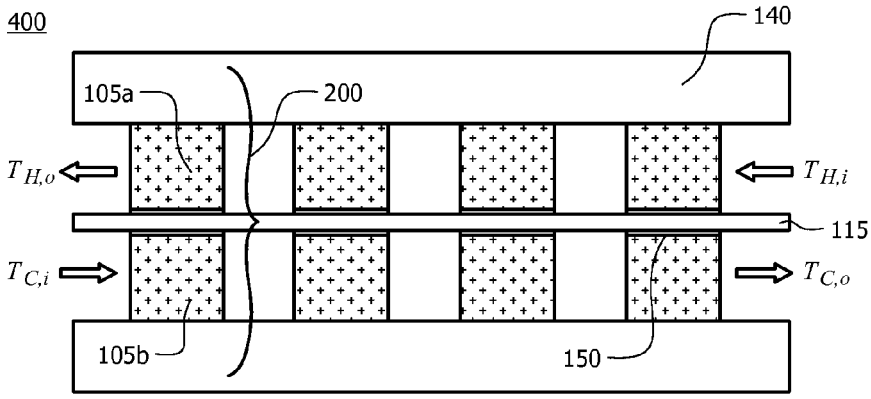
FIG. 4 shows the configuration of the middle four pairs of a six heat transfer pair heat exchanger used for experiments, according to an embodiment of the invention.

FIG. 4 shows the configuration of the middle four pairs of a six heat transfer pair heat exchanger 400 used for experiments. In the experiments performed, the flow was only measured for the middle four pairs depicted in FIG. 4 so that the end effects were eliminated. The heat transfer of the foam elements 105 was characterized by the heat transfer coefficient. The overall heat transfer coefficient U is based on the log-mean temperature difference, $$U = \frac{Q_{air}}{A\Delta T_m} \tag{2}$$

where $\Delta T_m$ is the log mean temperature difference, defined as:

$$\Delta T_m = \frac{(T_{H,i} - T_{C,o}) - (T_{H,o} - T_{C,i})}{\ln\left[\frac{T_{H,i} - T_{C,o}}{T_{H,o} - T_{C,i}}\right]} \tag{3}$$

$Q_{air}$ is the heat given up by the hot air that passes through the porous elements 105. It is calculated by $$Q_{air} = \dot{m}c_p(T_{H,i} - T_{H,o}) \tag{4}$$

and A is the heat transfer area between the hot and cold fluids.

The hot and cold inlet and outlet air temperatures are $T_{H,i}$, $T_{H,o}$, $T_{C,i}$ and $T_{C,o}$, respectively. The effectiveness of the heat exchanger is described by hot and cold side respectively:

$$\varepsilon_H = \frac{T_{H,i} - T_{H,o}}{T_{H,i} - T_{C,i}} \tag{5}$$

$$\varepsilon_C = \frac{T_{C,o} - T_{C,i}}{T_{H,i} - T_{C,i}} \tag{6}$$

$$\text{error} = \frac{|\varepsilon_H - \varepsilon_C|}{\varepsilon_H} \tag{7}$$

The averaged effectiveness $\epsilon$ of the heat exchanger 400 is calculated as:

$$\varepsilon = \frac{\varepsilon_H + \varepsilon_C}{2} \tag{8}$$

The air flow speed V, the outlet air temperature and inlet air temperature were measured in the experiment. The measured data were processed using these equations. The dimension of the experimental foam flow channel was 10 cm×1.7 cm×1 cm (l×w×h). The air inlet and outlet were 1.7 cm×1 cm (l×w) in dimension. The foam block 1 cm×1.7 cm×1 cm (l×w×h) was glued to a 0.1 mm thickness stainless steel plate using a silver loaded epoxy. This epoxy has a high thermal conductivity as compared to other epoxies and adhesives. Room temperature air was provided by the lab supply system and the same flow rate hot air is obtained by heating the outlet air flow. The foam was locked and sealed into a Plexiglas chamber. The test chamber was insulated and sealed.

The goal of the test was to measure the flow and heat transfer performance of open cell carbon foams when used as an air heat exchanger in forced flow. Carbon foam obtained from Poco Graphite described above was used in this experiment and had a reported density values of 0.6 g/cc and a bulk thermal conductivity of 135 W/m·K in the transverse direction (perpendicular to the flow directions) and 45 W/m·K in the other two directions. The foam occupied the entire cross section of the channel. The foam acts as a fin structure to conduct heat from the bottom wall into the interior of the channel so that heat can be effectively removed by the cold air flowing through. Pressure taps were placed at the inlet and outlet to evaluate the pressure drop. The substrate temperatures were measured by three 0.3 mm thermocouples which were put into the four pairs of foam elements (as shown in FIG. 4) to evaluate the inlet and outlet temperatures and to evaluate the heat transfer. The air flow rate was measured with a flow meter.

The quantities measured in the experiments included the temperatures at the inlet and outlet ($T_{C,i}$, $T_{C,o}$, $T_{H,i}$, $T_{H,o}$, i.e., cold/hot air inlet/outlet temperatures), and the volumetric flow rate. All data collection was automated using an automated data acquisition system and a personal computer.

Figure 5:
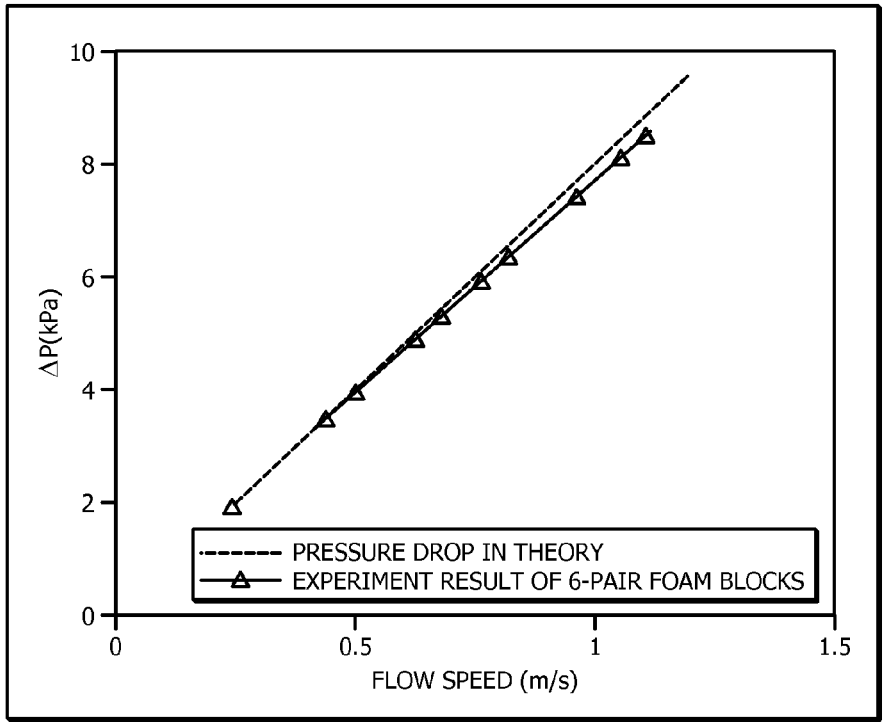
FIG. 5 shows a comparison of theoretical and measured porous element flow resistance, according to an embodiment of the invention.

The pressure difference across the four foam elements was measured at various air flow speeds. As shown in FIG. 5, the pressure drop at V=1 m/s is approximately 1 psi. The flow rate was measured by a flowmeter which was calibrated with a high precision mass flow meter. The error in temperature measurement was within 0.2° C. The errors for pressure difference and flow rate were estimated to be less than ±10 Pa and 1.2%, respectively. The error in U was less than 5%.

There are expected to be numerous applications for heat exchangers according to embodiments of the invention based on the feature combination of lightweight, compact and high effectiveness generally provided. Exemplary applications include a recuperative heat exchanger for cryocoolers for space exploration or high temperature superconductors, micro or mini turbines, thermal management in hybrid automobiles, and environmental (thermal and moisture) control for fuel cells.

Regarding cryocoolers, NASA has identified supportability as a key requirement for the development of future space exploration architectures. Storage of oxygen is essential for a sustainable consumables transfer station for use on the lunar surface. A new cryogenic system that incorporates integrated refrigeration with a Brayton DC cycle and oxygen storage is described below to meet the envisioned architectural requirements as well as to increase the mission capabilities. As known in the art, a Reverse Brayton cryocooler generally includes a cold head and recuperator heat exchanger which are embodied as separate components that each provide different functions to achieve cryocooling. In the cold head, heat exchange is between the working fluid of the cryocooler (e.g., nitrogen) and the fluid to be cooled or liquefied (e.g., oxygen). In the recuperator heat exchanger, heat exchange is between the working fluid (e.g., nitrogen) at two different parts of the thermodynamic cycle of the cryocooler.

A high effectiveness (e.g., $\epsilon$>98%) heat exchanger is an important component for maintaining an integrated system at a high operational coefficient of performance (COP), thereby reducing energy consumption. For example, in order to achieve the removal of 48 W of heat at the cold head for liquefaction and storage of oxygen with zero boil-off, the heat exchanger must have about a 2,000 W capacity for heat transfer. Embodiments of the invention can provide the recuperator heat exchanger having the needed high effectiveness.

Other applications include distributed and mobile power generation systems based on Brayton engines and heat recovery for solar and other (e.g., geothermal) renewable energy. In the case of microturbines for distributed power generation, there is a "similar but exactly opposite" situation, a recuperator is used to recoup the waste heat for pre-heating the inlet air. This increases the overall efficiency of the microturbine very significantly. The recuperators in conventional microturbines are much larger than recuperators according to embodiments of the invention.

Yet other exemplary applications include military applications in which the exhaust from engines (both for propulsion and for power generation) can be a major concern because the hot exhaust introduces infrared signature that is possible to detect. Without proper measures to reduce IR signature, these engines can make the associated military platforms easy targets. A compact, lightweight recuperator according to an embodiment of the invention can be used to pre-heat the inlet air (save fuels) while cooling the exhaust to a temperature close to the ambient temperature. This can help reduce the IR signature very significantly.

EXAMPLES

The following non-limiting Examples serve to illustrate selected embodiments of the invention. It will be appreciated that variations in proportions and alternatives in elements of the components shown will be apparent to those skilled in the art and are within the scope of embodiments of the present invention.

FIG. 5 shows a comparison of the theoretical and measured foam flow resistance of the four heat transfer pair experiment. The foam flow resistance was calculated from classical porous media theory. The relationship between pressure drop and the average channel velocity can be expressed by the Forchheimer equation.

$$\frac{\Delta p}{\Delta x} = \frac{\mu}{K}u + \frac{\rho F}{\sqrt{K}}u^2 \tag{9}$$

where μ, K and p are dynamic viscosity, permeability of the foam, and density of the air, respectively. F is the inertia coefficient reflecting porous inertia effects. It is a function of the microstructure of the porous medium. The measured permeability and inertia coefficient are about $1.5\times10^{-10}$ $m^2$ and 0.4457 for POCO FOAM™ FIG. 5 also shows the comparison between the theoretical and measured (experimental) foam flow resistances, which demonstrates fairly good agreement Table 1 (shown below) shows the heat transfer results for four heat transfer pairs comprising foam blocks at air flow speeds from 0.25~1.0 m/s. The measured overall heat transfer coefficient was 568 $W/m^2K$ at the speed of 1.0 m/s. Table 1 also includes five sets of data for different cold and hot inlet temperatures at the 0.5 m/s air flow speed. The overall heat transfer coefficient varied from 366 to 356 $W/m^2\cdot K$ even while the log mean temperature varied from 2.1 to 6.2° C.

TABLE 1

Experiment Results

| $T_{H,i}$(° C.) | $T_{H,o}$(° C.) | $T_{C,i}$(° C.) | $T_{C,o}$(° C.) | $\Delta T_m$(° C.) | V(m/s) | $\epsilon_H$ | $\epsilon_C$ | Error(%) | $\epsilon$ | U($W/m^2\cdot K$) |
|---|---|---|---|---|---|---|---|---|---|---|
| 22.1 | 19.8 | 19.3 | 21.8 | 0.4 | 0.25 | 0.84 | 0.87 | 3.1 | 0.86 | 216 |
| 29.9 | 16.5 | 14.3 | 27.2 | 2.4 | 0.38 | 0.86 | 0.83 | 3.5 | 0.84 | 305 |
| 24.9 | 14.7 | 12.5 | 23.0 | 2.1 | 0.5 | 0.83 | 0.84 | 2.0 | 0.83 | 366 |
| 26.4 | 15.1 | 12.9 | 24.1 | 2.3 | 0.5 | 0.83 | 0.83 | 0.1 | 0.83 | 365 |
| 42.7 | 22.4 | 17.9 | 38.9 | 4.2 | 0.5 | 0.82 | 0.85 | 3.2 | 0.83 | 359 |
| 49.5 | 20.9 | 14.6 | 44.0 | 5.9 | 0.5 | 0.82 | 0.84 | 2.7 | 0.83 | 358 |
| 63.5 | 33.5 | 27.0 | 57.7 | 6.2 | 0.5 | 0.82 | 0.84 | 2.1 | 0.83 | 356 |
| 25.1 | 14.4 | 12.1 | 22.9 | 2.3 | 0.67 | 0.82 | 0.83 | 1.3 | 0.83 | 465 |
| 24.7 | 16.0 | 13.6 | 22.5 | 2.3 | 1 | 0.79 | 0.80 | 1.5 | 0.80 | 568 |

Figure 6:
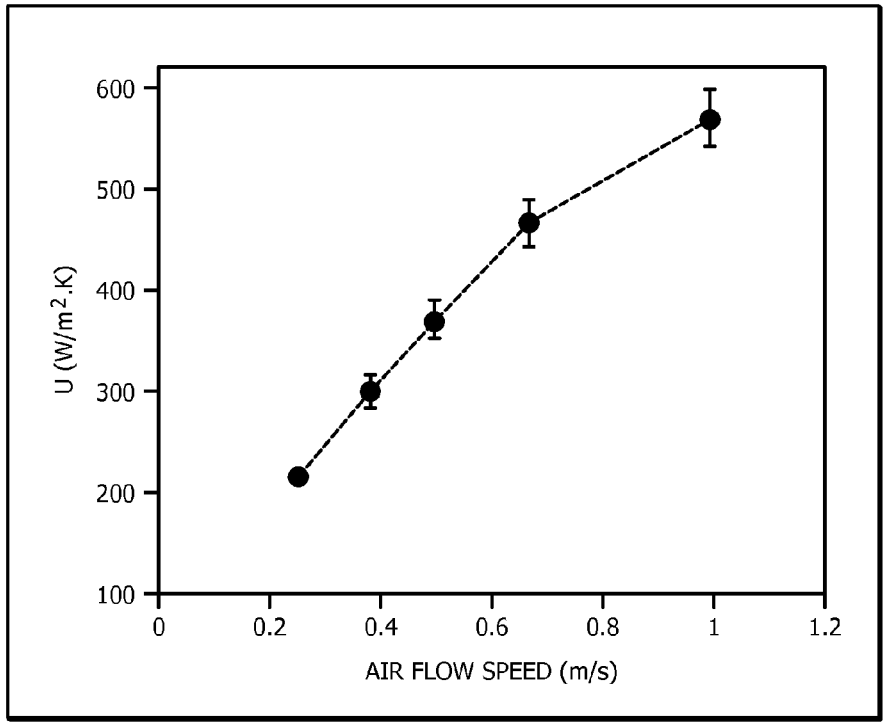
FIG. 6 shows the overall heat transfer coefficient U vs. air flow speed, according to an embodiment of the invention.

FIG. 6 shows the measured overall heat transfer coefficient U of a recuperator with four heat transfer pair comprising foam block arrangement. These measured values are about an order of magnitude higher than those if carbon foams were not used. The results demonstrate that carbon foam is a good medium for heat transfer enhancement because of its high thermal conductivity.

Figure 7:
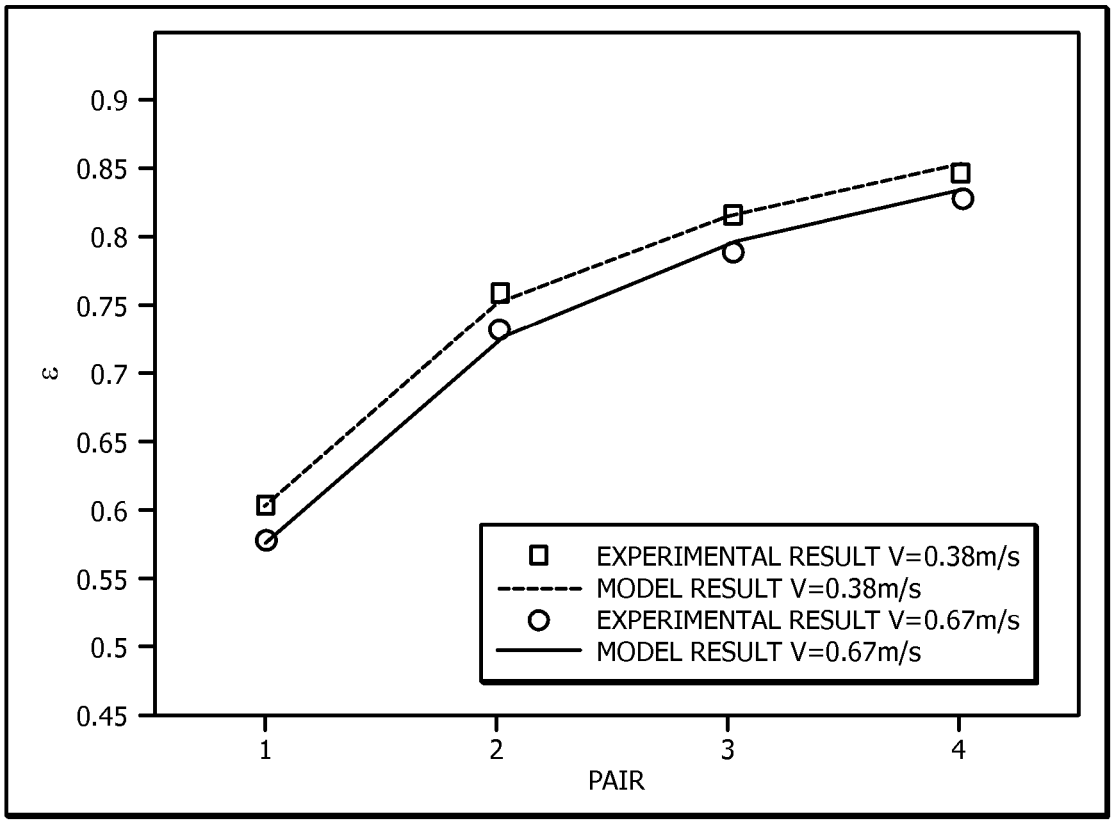
FIG. 7 shows a comparison of theoretical and measured effectiveness for a four heat transfer pair comprising foam block arrangement, according to an embodiment of the invention.

FIG. 7 shows a comparison of the theoretical and measured effectiveness for a four heat transfer pair comprising foam block arrangement. The averaged effectiveness was calculated from Equations (5), (6) and (8) based on the measured air temperatures between the foam blocks. The averaged difference in effectiveness of the heat exchanger between the hot and cold sides is within 5%. The theoretical effectiveness is based on the Equation (1) using temperatures found from the previously described COMSOL model. The theoretical effectiveness is $\epsilon$=0.59 and $\epsilon$=0.63 based on simulation when the flow velocity is V=0.67 m/s and V=0.38 m/s. $\epsilon$=0.57 and $\epsilon$=0.61 are measured value of one pair foam, respectively. The experimental results follow the theoretical prediction. FIG. 7 also shows that the four-pair foam blocks can reach $\epsilon$=0.80 successfully. The agreement between the theoretical and measured effectiveness for one to four pairs of carbon foam blocks indicates the validity of Equation (1). Thus the effectiveness can be as high as $\epsilon$=0.98 by using 50 pairs of foam blocks.

Embodiments of the invention can be embodied in other forms without departing from the spirit or essential attributes thereof and, accordingly, reference should be had to the following claims rather than the foregoing specification as indicating the scope of the invention.

In the preceding description, certain details are set forth in conjunction with the described embodiment of the present invention to provide a sufficient understanding of the invention. One skilled in the art will appreciate, however, that the invention may be practiced without these particular details. Furthermore, one skilled in the art will appreciate that the example embodiments described above do not limit the scope of the present invention and will also understand that various modifications, equivalents, and combinations of the disclosed embodiments and components of such embodiments are within the scope of the present invention.

Moreover, embodiments including fewer than all the components of any of the respective described embodiments may also within the scope of the present invention although not expressly described in detail. Finally, the operation of well known components and/or processes has not been shown or described in detail below to avoid unnecessarily obscuring the present invention. One skilled in the art will understood that even though various embodiments and advantages of the present Invention have been set forth in the foregoing description, the above disclosure is illustrative only, and changes may be made in detail, and yet remain within the broad principles of the invention.

We claim:

1. A heat exchanger, comprising:

at least one hot fluid flow channel comprising a first plurality of open cell porous elements having first gaps therebetween for flowing a hot fluid in a flow direction;

at least one cold fluid flow channel comprising a second plurality of open cell porous elements having second gaps therebetween for flowing a cold fluid in a countercurrent flow direction relative to said flow direction, wherein a thermal conductivity of said first and said second plurality of porous elements is at least 10 W/m·K, and a separation member interposed between said hot and said cold flow channels for isolating flow paths associated with said hot and said cold flow channels, wherein said first and said second plurality of porous elements at least partially overlap one another to form a plurality of heat transfer pairs, said plurality of heat transfer pairs transferring heat from respective ones of said first plurality of porous elements to respective ones of said second plurality of porous elements through said separation member;

wherein said first plurality of porous elements are completely physically separated from one another by said first gaps and said second plurality of porous elements are completely physically separated from one another by said second gaps, said first gaps and said second gaps being 1 to 10 mm in size.

2. The heat exchanger of claim 1, wherein said at least one hot fluid flow channel comprises a plurality of the hot fluid flow channels and said at least one cold fluid flow channel comprises a plurality of the cold fluid flow channels, said plurality of the hot fluid flow channels and said plurality of the cold fluid flow channels arranged in a stacked alternating configuration.

3. The heat exchanger of claim 1, wherein said separation member has a thickness <1 mm and comprises a material that provides a 25° C. thermal conductivity of <30 W/m·K.

4. The heat exchanger of claim 1, wherein said first and said second plurality of porous elements comprise a foam.

5. The heat exchanger of claim 4, wherein said foam comprises a graphitic carbon foam that provides a bulk thermal conductivity at 25° C. of >100 W/m·K in at least one direction.

6. The heat exchanger of claim 1, wherein said first and second gaps are at least partially filled with an open cell material that provides a bulk thermal conductivity at 25° C. of <1 W/m·K.

7. The heat exchanger of claim 1, wherein a length of said first and said second plurality of porous elements in said flow and said countercurrent flow direction is between 5 and 20 mm.

8. The heat exchanger of claim 1, further comprising a thermally conductive adhesive for bonding said first and second plurality of porous elements to said separation member.

9. The heat exchanger of claim 1, wherein said plurality of heat transfer pairs number at least twenty.

10. A heat exchanger, comprising:

at least one hot fluid flow channel comprising a first plurality of open cell graphitic carbon foam elements having first gaps therebetween for flowing a hot fluid in a flow direction;

at least one cold fluid flow channel comprising a second plurality of open cell graphitic carbon foam elements having second gaps therebetween for flowing a cold fluid in a countercurrent flow direction relative to said flow direction, wherein a thermal conductivity of said first and said second plurality of graphitic carbon foam elements at 25° C. is >100 W/m·K in at least one direction;

a separation member having a thickness <1 mm and comprising a material that provides a 25° C. thermal conductivity of <30 W/m·K interposed between said hot and said cold flow channels for isolating flow paths associated with said hot and said cold flow channels, wherein said first and said second plurality of graphitic carbon foam elements at least partially overlap one another to form a plurality of heat transfer pairs, said plurality of heat transfer pairs transferring heat from respective ones of said first plurality of graphitic carbon foam elements to respective ones of said second plurality of graphitic carbon foam elements through said separation member;

wherein said first plurality of porous elements are completely physically separated from one another by said first gaps and said second plurality of porous elements are completely physically separated from one another by said second gaps, said first gaps and said second gaps being 1 to 10 mm in size.

11. The heat exchanger of claim 10, wherein said at least one hot fluid flow channel comprises a plurality the of hot fluid flow channels and said at least one cold fluid flow channel comprises a plurality of the cold fluid flow channels, said plurality of the hot fluid flow channels and said plurality of the cold fluid flow channels arranged in a stacked alternating configuration.

12. The heat exchanger of claim 10, further comprising a thermally conductive adhesive for bonding said first and second plurality of porous elements to said separation member.

13. A method of heat exchange, comprising:

providing at least one hot fluid flow channel comprising a first plurality of open cell porous elements which are completely physically separated from one another by first gaps therebetween, at least one cold fluid flow channel comprising a second plurality of open cell porous elements which are completely physically separated from one another by second gaps therebetween, wherein a thermal conductivity of said first and said second plurality of porous elements is at least 10 W/m·K, and a separation member is interposed between said hot and said cold flow channels for isolating flow paths associated with said hot and said cold flow channels, wherein said first and said second plurality of porous elements at least partially overlap one another to form a plurality of heat transfer pairs, flowing a hot fluid in a flow direction into said hot flow channel;

flowing a cold fluid in a countercurrent flow direction relative to said flow direction into said cold flow channel;

wherein said plurality of heat transfer pairs transfer heat from respective ones of said first plurality of porous elements to respective ones of said second plurality of porous elements through said separation member.

14. The method of claim 13, wherein said separation member has a thickness <1 mm and comprises a material that provides a 25° C. thermal conductivity of <30 W/m·K.

15. The method of claim 13, wherein said first plurality of porous elements comprise a first plurality of graphitic carbon foam elements and said second plurality of porous elements foam comprise a second plurality of graphitic carbon foam elements.

16. The method of claim 15, wherein said first plurality of graphitic carbon foam elements are completely physically separated from one another by said first gaps and said second plurality of graphitic carbon foam elements are completely physically separated from one another by said second gaps, said first gaps and said second gaps being 1 to 10 mm in size.

* * * * *